US005620621A

United States Patent [19]

Sontag

[11] Patent Number: 5,620,621

[45] Date of Patent: Apr. 15, 1997

[54] GLOVE HAVING HEATING ELEMENT LOCATED IN THE PALM REGION

[76] Inventor: Richard L. Sontag, 400 E. 71st St., New York, N.Y. 10021

[21] Appl. No.: 229,596

[22] Filed: Apr. 19, 1994

[51] Int. Cl.[6] ..... A41D 19/00

[52] U.S. Cl. ..... 219/211; 219/549; 2/160; 2/158

[58] Field of Search ..... 2/159, 160, 163, 2/164, 905, 161.5, 161.6, 158; 219/16, 211, 528, 549

[56] References Cited

U.S. PATENT DOCUMENTS

| | | | |
|---|---|---|---|
| 721,270 | 2/1903 | Zeckendorf | 2/905 |
| 1,073,926 | 9/1913 | Pollak | 2/905 |
| 1,284,378 | 11/1918 | Lemercier | 2/905 |
| 1,362,351 | 12/1920 | Rankin | 2/905 |
| 2,227,781 | 1/1941 | Joy | 2/905 |
| 3,569,666 | 3/1971 | Murphy | 219/211 |
| 3,621,191 | 11/1971 | Cornwell | 219/211 |
| 3,632,966 | 1/1972 | Arron | 219/211 |
| 3,649,966 | 3/1972 | Shields | 2/160 |
| 3,781,514 | 12/1973 | Olson | 219/211 |
| 4,021,640 | 5/1977 | Gross | 219/211 |
| 4,087,675 | 5/1978 | Sansonetti | 2/158 |
| 4,764,665 | 8/1988 | Orban | 219/211 |
| 4,950,868 | 8/1990 | Moss | 219/211 |

FOREIGN PATENT DOCUMENTS

| | | | |
|---|---|---|---|
| 2645410 | 10/1990 | France | 2/160 |
| 809924 | 7/1949 | Germany | 219/211 |
| 3416366 | 11/1985 | Germany | 219/211 |

*Primary Examiner*—C. D. Crowder
*Assistant Examiner*—Larry D. Worrell, Jr.
*Attorney, Agent, or Firm*—Ostrolenk, Faber, Gerb & Soffen, LLP

[57] ABSTRACT

A heated glove includes a glove body having an outer shell and an inner liner conforming to the shape of the glove body. The inner liner defines a hand receiving portion and includes a palm side and an opposing back side. The hand receiving portion has a width and a length and an opening for receiving therethrough a hand of a glove wearer. The palm side of the inner liner includes a region that lies adjacent the area substantially between the digital/palmar creases and the distal palmar creases of the palm of the glove wearer. A heating element is disposed at the region and substantially spans across the width of the hand receiving portion. A source of energy energizes the heating element. A seal substantially seals the opening during use.

25 Claims, 6 Drawing Sheets

FIG. 6
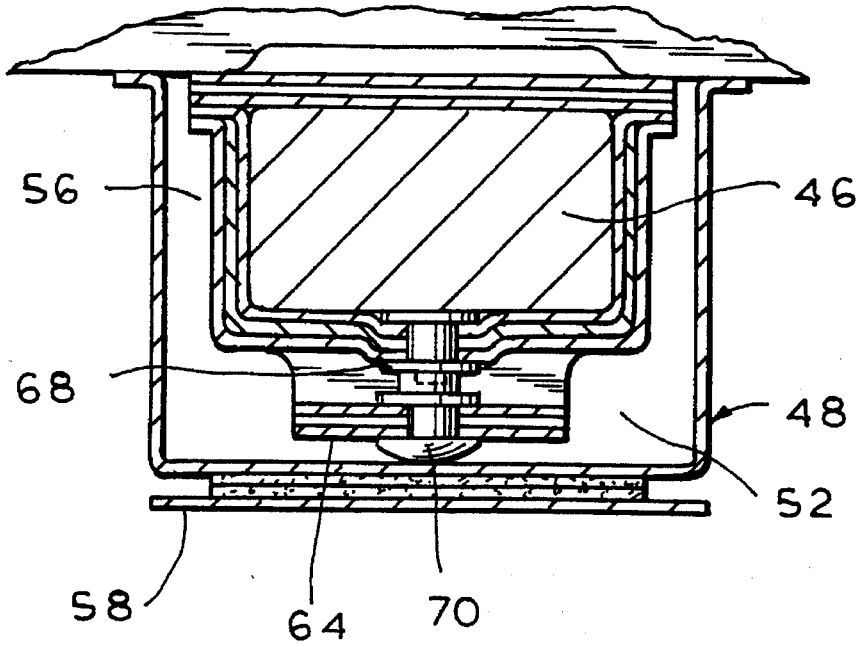
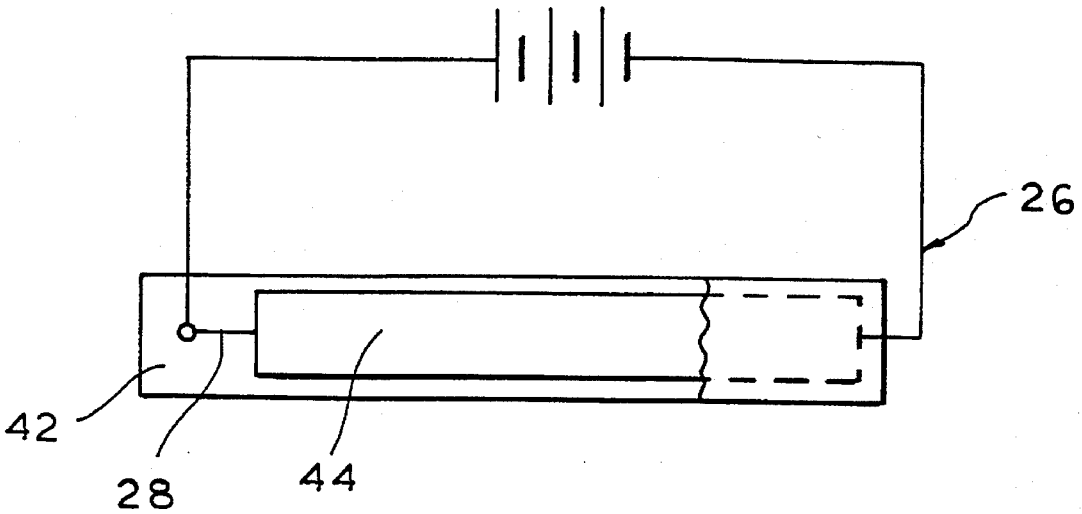
FIG. 7

GLOVE HAVING HEATING ELEMENT LOCATED IN THE PALM REGION

BACKGROUND OF THE INVENTION

1. Field of the Invention

The present invention relates to a glove and more particularly to an electrically heated glove.

2. Description of the Prior Art

Heated garments of the prior art, for example, heated gloves, include heating elements to provide comfort to the glove wearer under extreme frigid conditions. A difficulty with these prior art gloves is that the heating element extends throughout the glove body across the palm area and up through the finger area. This results in overheating of the hand of the glove wearer and since batteries are typically used to provide the electrical source and are of limited capacity, such overheating results in premature depletion of the batteries.

Placement of the heating element of gloves of the prior art across the palm area and up through the finger area also subjects the heating element to undue stresses and strains caused by the bending of the finger and palm areas of the hand, e.g., the bending of the MCP joint, and results in the degradation of the heating element. The location of the heating element is also in the area of the glove body where the wearer grips things, e.g., ski poles, pails, shotguns, farm equipment and the like, causing abrasion of the heating element.

Moreover, gloves of the prior art in an attempt to provide sufficient insulation often include excessive amounts of insulation material distributed throughout the glove body resulting in an oversized, cumbersome glove which impedes movement of the wearer's hand.

SUMMARY OF THE INVENTION

Accordingly, it is an object of the present invention to provide an electrically heated glove to warm the glove without overheating the glove enabling the wearer to remain in the cold longer.

Another object is to provide such a glove including a heating means that is not subject to stresses and strains caused by movement of the hand.

A further object is to provide such a glove including a heating means that is not subject to abrasions from carrying ski poles, pails, farm equipment and the like.

It is also an object to provide such a glove with the proper amount of insulation to maximize the capture of heat and to minimize the size and bulk of the glove.

It is another object to provide such a glove that is simple and economical to use and manufacture.

It has been found that the above and other objects of the present invention are attained in a heated glove that includes a glove body having an outer shell and an inner liner conforming to the shape of the glove body. The inner liner defines a hand receiving portion and includes a palm side and an opposing back side. The hand receiving portion has a width and a length and an opening for receiving therethrough a hand of a glove wearer. The palm side of the inner liner includes a region that lies adjacent the area substantially between the digital/palmar creases and the distal palmar creases of the palm of the glove wearer. A heating element is disposed at the region and substantially spans across the width of the hand receiving portion. A source of energy energizes the heating element. A seal substantially seals the opening during use.

In a preferred embodiment, the heated glove includes insulation disposed between the outer shell and the inner liner. Preferably the seal substantially seals the opening when the hand of the glove wearer is received in the hand receiving portion to form an insulated chamber defined by the inner liner and the seal, the heating element radiating heat into the insulated chamber to heat the hand of the glove wearer when the heating element is energized.

In a preferred embodiment, the insulation includes a plurality of insulating layers. Preferably, the insulating layers include a layer of polyester fiberfill and a layer of material made up of 65% olefin and 35% polyester and the inner liner is made of polyester and the outer shell is made of nylon. A waterproof liner is disposed between the outer shell and the inner liner.

In a preferred embodiment, the heating element is a resistance type heating element. Preferably, the heating element is disposed between layers of nylon heat sensitive tape. The inner liner includes two layers of polyester, and the heating element is disposed between the two polyester layers.

Preferably, the seal includes an elastic band which substantially seals the inner liner of the hand receiving portion around the wrist area of the hand when the hand is in the hand receiving portion. In a preferred embodiment, the seal further includes a strap which substantially seals the inner liner of the wrist portion around the wrist area of the hand when the hand is in the glove portion. The source of energy includes a battery.

In a preferred embodiment, the outer shell includes a palm side and an opposing back side. The inner liner further defines a wrist portion integrally connected to the hand receiving portion, and the wrist portion includes a compartment on the back side of the outer shell.

Preferably, the compartment includes an outer compartment and an inner compartment. The inner compartment houses the battery and includes means for operatively engaging the battery and the heating element. The inner compartment includes a switch for energizing and de-energizing the heating element.

In a preferred embodiment, the inner compartment includes a flap to close and open the inner compartment. Preferably, the switch is adapted and arranged so that the heating element is energized when the flap is closed, and the heating element is de-energized when the flap is open.

Preferably, the heated glove includes means for balancing the battery when housed in the inner compartment. Preferably, the means for balancing includes a strap.

In a preferred embodiment, the heated glove includes a glove body having an outer shell and an inner liner conforming to the shape of the glove body, the inner liner defining a hand receiving portion having a palm region, a finger region and an opening for receiving therethrough a hand of a glove wearer. Insulation is disposed between the outer shell and the inner liner and a seal substantially seals the hand receiving portion when a hand of a glove wearer is received in the hand receiving portion to form an insulated chamber defined by the inner liner and the seal. Preferably a means is included for delivering heat to, and concentrating heat in, the palm region to warm the insulated chamber.

In a preferred embodiment, the means for delivering heat includes a heating element disposed at the inner liner, and the heating element is adapted and arranged so that it does not substantially bend when the hand of a glove wearer is bent.

Other features and advantages of the present invention will become apparent from the following description of the invention which refers to the accompanying drawings.

BRIEF DESCRIPTION OF THE DRAWINGS

For the purpose of illustrating the invention, there is shown in the drawings an embodiment which is presently preferred; it being understood, however, that the invention is not limited to the precise arrangements and instrumentalities shown.

FIG. 6 is a cross-sectional view taken along line 6—6 of FIG. 2.

FIG. 7 is a schematic view of the heating element of the heated glove of the present invention.

DETAILED DESCRIPTION OF THE INVENTION

Figure 1:
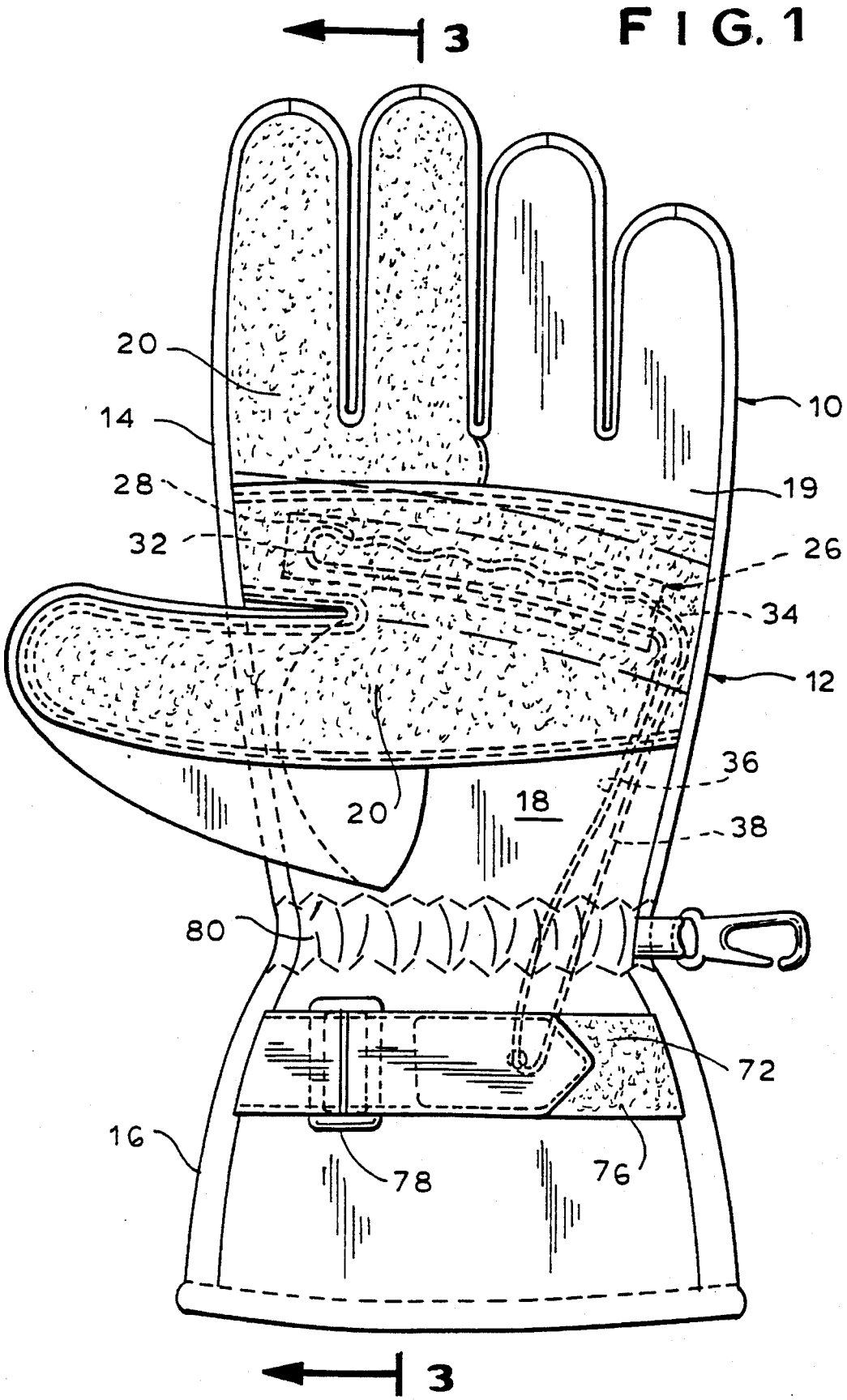
FIG. 1 is a bottom plan view of the heated glove of the present invention.
Figure 2:
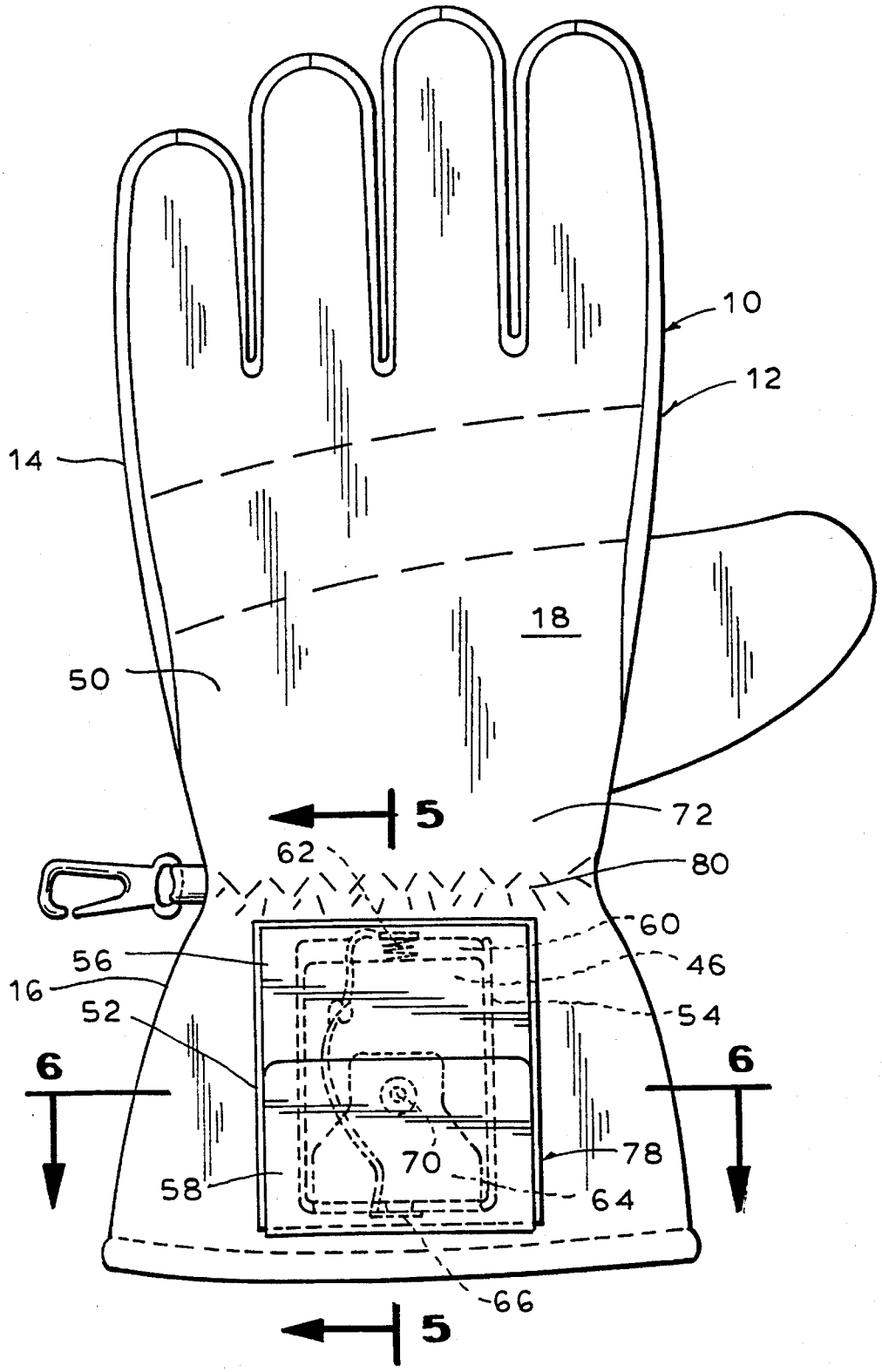
FIG. 2 is a top plan view of the heated glove of the present invention.
Figure 3:
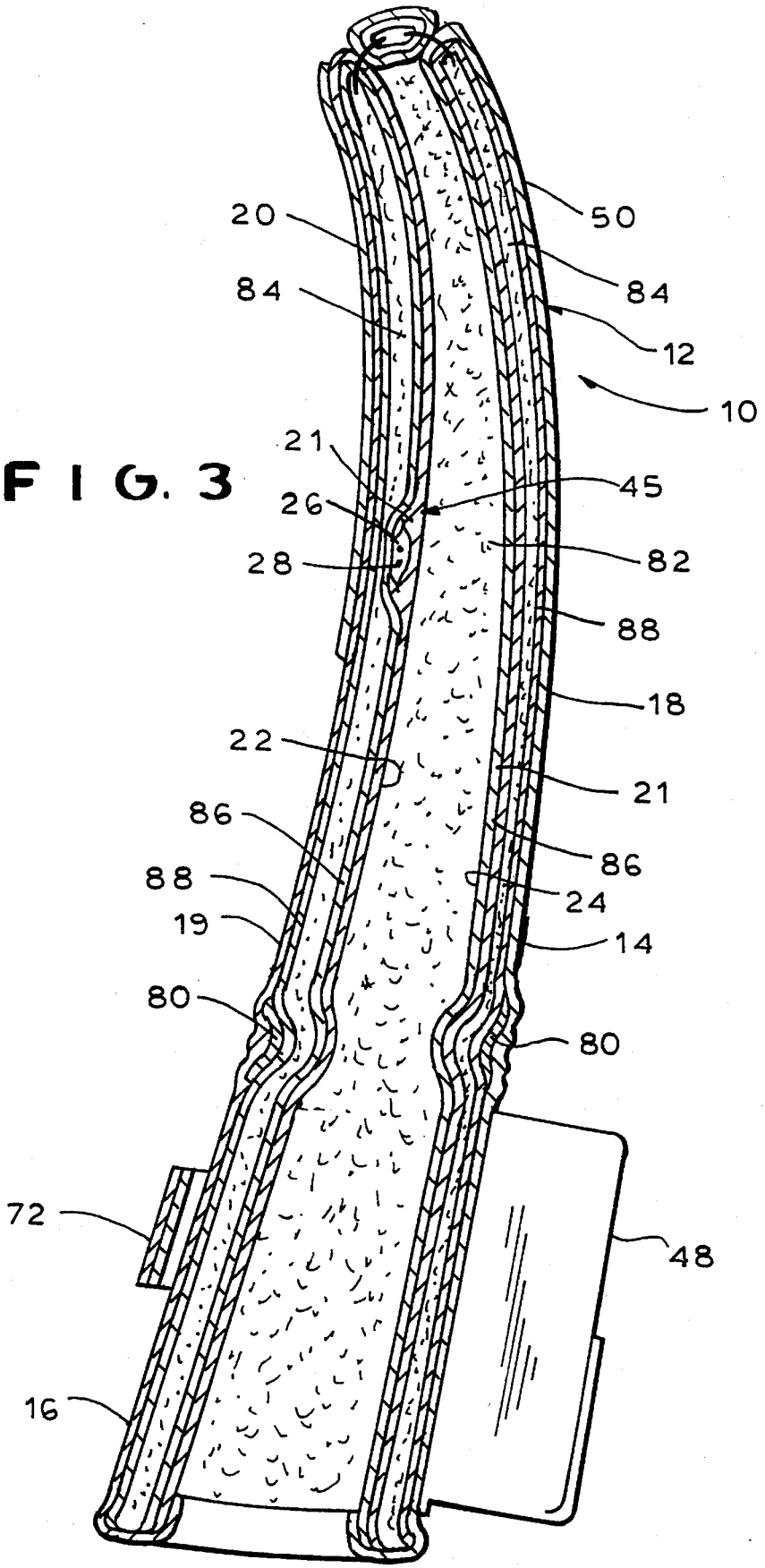
FIG. 3 is a cross-sectional view taken along line 3—3 of FIG. 1.

Referring now to the drawings wherein like numerals indicate like elements, there is shown in FIGS. 1–3 a heated glove of the present invention generally designated by the reference numeral 10. The heated glove 10 in its conventional aspects includes a glove body 12 having a hand receiving portion 14 to receive the hand of a wearer and a wrist portion 16 to surround the wrist of the wearer. The glove body 12 can take the form of any style glove including hand gloves, mittens, etc, and in its conventional aspects, can be formed of any of the known materials and made in accordance with any of the known constructions for making gloves.

The glove body 12 includes an outer shell 18 that can be formed of any of the known materials and made in accordance with any of the known constructions for making gloves. In a preferred embodiment, the outer shell 18 is made of nylon or polyester.

The palm side 19 of the outer shell 18 includes a palm patch 20. Preferably, the palm patch 20 covers a portion of the palm side 19 of the outer shell 18, (FIG. 1), and is made in accordance with any of the known constructions for making gloves. In a preferred embodiment, the palm patch 20 is made of polyvinylchloride (PVC).

Referring now to FIG. 3, the hand receiving portion 14 and the wrist portion 16 are defined by an inner liner 21 that complements the outer shell 18. The inner liner 21 conforms substantially to the shape of the glove body 12. The inner liner 21 includes a palm side 22 that faces the palm side of the wearer's hand, and an opposing back side 24 that faces the back side of the wearers hand. The inner liner 21 can be formed of any of the known materials and made in accordance with any of the known constructions for making gloves. In a preferred embodiment, the inner liner 21 is made of polyester or cotton.

An auxiliary source of heat is located within the palm side 22 of the inner liner 21 to provide heat to the wearer of the glove 10. In a preferred embodiment, the auxiliary source of heat includes a standard low voltage resistance type heating element (less than 3 volts) that is well known in the art and is capable of being energized by a low voltage battery (e.g., 1.5 volts) carried directly on the glove to provide the wearer of the glove with complete freedom of movement. The heated glove 10 of the present invention can be worn either as a conventional glove, or as an electrically heated glove.

Referring now to FIGS. 1, 3 and 7, a heater assembly 26 includes a resistance type heating element 28 that can be made from any of the known materials. Preferably, the heating element 28 is made of a resistance alloy and is shaped in a heartbeat pattern, or shaped to have a sine wave bend, FIG. 1. It should be understood, however, that the heating element can be of any dimension or shape, e.g., straight, and may be varied depending on the resistance characteristics of a particular resistor element, just so long as the heating element 28 warms the wearers hand in accordance with the present invention.

The free ends 32, 34 of the heating element 28 are electrically connected to conductive wires 36, 38 respectively, by any of the known methods. Preferably, the free ends 32, 34 are connected to the conductive wires 36, 38 by splicing in a brass electronic connector, not shown. The conductive wires 36, 38 can be made of any of the known materials. In a preferred embodiment, the conductive wires 36, 38 are made of 7-strand copper.

Referring now to FIG. 7, the heating element 28 is sandwiched between opposing strips 40, 42 of a heat diffusible material which forms a covering for the heating element 28. The strips 40, 42 function to diffuse and conduct the heat generated by the heating element 28 and also functions to maintain the shape of the element 28 and to keep it from breaking. Preferably the strips 40, 42 are made of nylon heat sensitive tape although it should be realized that the strips 40, 42 can be made of any of the known materials that function to cover, and diffuse heat radiating from, the heating element 28 without harm to the wearer of the glove 10. For example, the strips 40, 42 can be made of metallic foil, plastic tape, fabric tape, and fiberglass that will permit heat to be conducted and/or radiated therethrough and/or be diffused in an amount which prohibits the formation of excessive hot spots which may otherwise burn or injure the wearer.

In a preferred embodiment, the heater assembly 26 may further include a synthetic fiber pad 44 disposed between the heating element 28 and one of the strips 40, 42. Preferably, the synthetic fiber pad 44 should be placed between the heating element 28 and one of the strips 40, 42 that faces the palm side 22 of the inner liner 21.

The heater assembly 26 is disposed within the palm side 22 of the inner liner 21 at a region 45 that is adapted to be in contact with, or adjacent to, the area of the palm side of the glove wearer's hand, i.e. the volar surface, defined proximally by the distal palmar creases (caused by a bending of the MCP or knuckle joint) and distally by the digital/palmar creases (at the base of the top four fingers or finger line). The heating element 28 of the heater assembly 26 should span substantially across the width of the hand receiving portion 14 at the region 45. Preferably the inner liner 21 is comprised of two layers of polyester and the heater assembly 26 is disposed between the two layers.

Placement of the heater assembly 26 at the region 45 serves to prolong the life of the heating element 28 because it is in an area of the glove 10 that does not significantly bend along with the bending of the glove wearer's hand (e.g., at the MCP joint) or fingers. Extending the heating element 28 to areas of the glove 10 that significantly bend along with the bending of the glove wearer's hand, e.g., an area of the glove 10 adjacent or extending across or over the palmar creases of the glove wearer's hand, as in heated gloves of the prior art, causes the heating element 28 to significantly bend. This results in the degradation of the heating element 28. Moreover, by positioning the heating element 28 at the region 45, it is outside the area of the glove wearer's hand that is used to grip things. This further serves to prolong the life of the heating element 28 because e.g., abrasions from gripping ski poles and the carrying of pails, shotguns, farm equipment and the like are avoided.

Referring now to FIGS. 2, 4, 5 and 6, a battery 46 is used to energize the heating element 28 by operatively engaging the heating element 28 via the conductive wires 36, 38 by any of the known methods. The battery 46 can be a flashlight type battery having a voltage capacity of approximately 1.5 volts. The battery 46 can be a standard "D" size dry cell flashlight battery, an alkaline battery, a nickel cadmium battery or any other battery of like low voltage capacity.

The battery 46 is housed in a compartment 48 secured to the wrist portion 16 on the back side 50 of the outer shell 18. The compartment 48 is so positioned to balance the weight of the battery 46 centered therein, therefore, rendering the presence of the battery practically unnoticeable to the wearer of the glove 10 and provides for minimum interference with other wearing apparel, e.g., the sleeve and cuffs of other garments.

Figure 4:
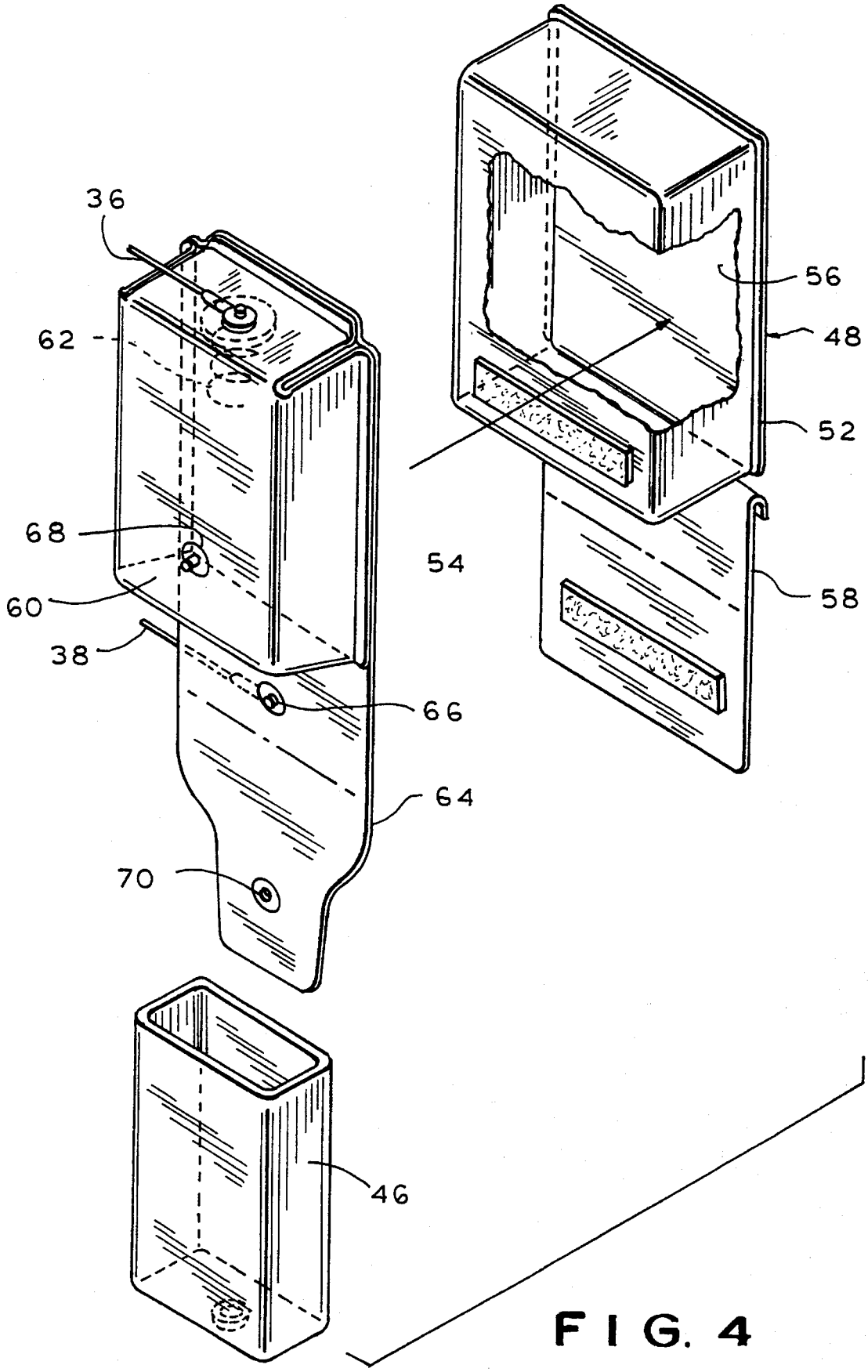
FIG. 4 is an exploded view of the battery compartment of the heated glove of the present invention.
Figure 5:
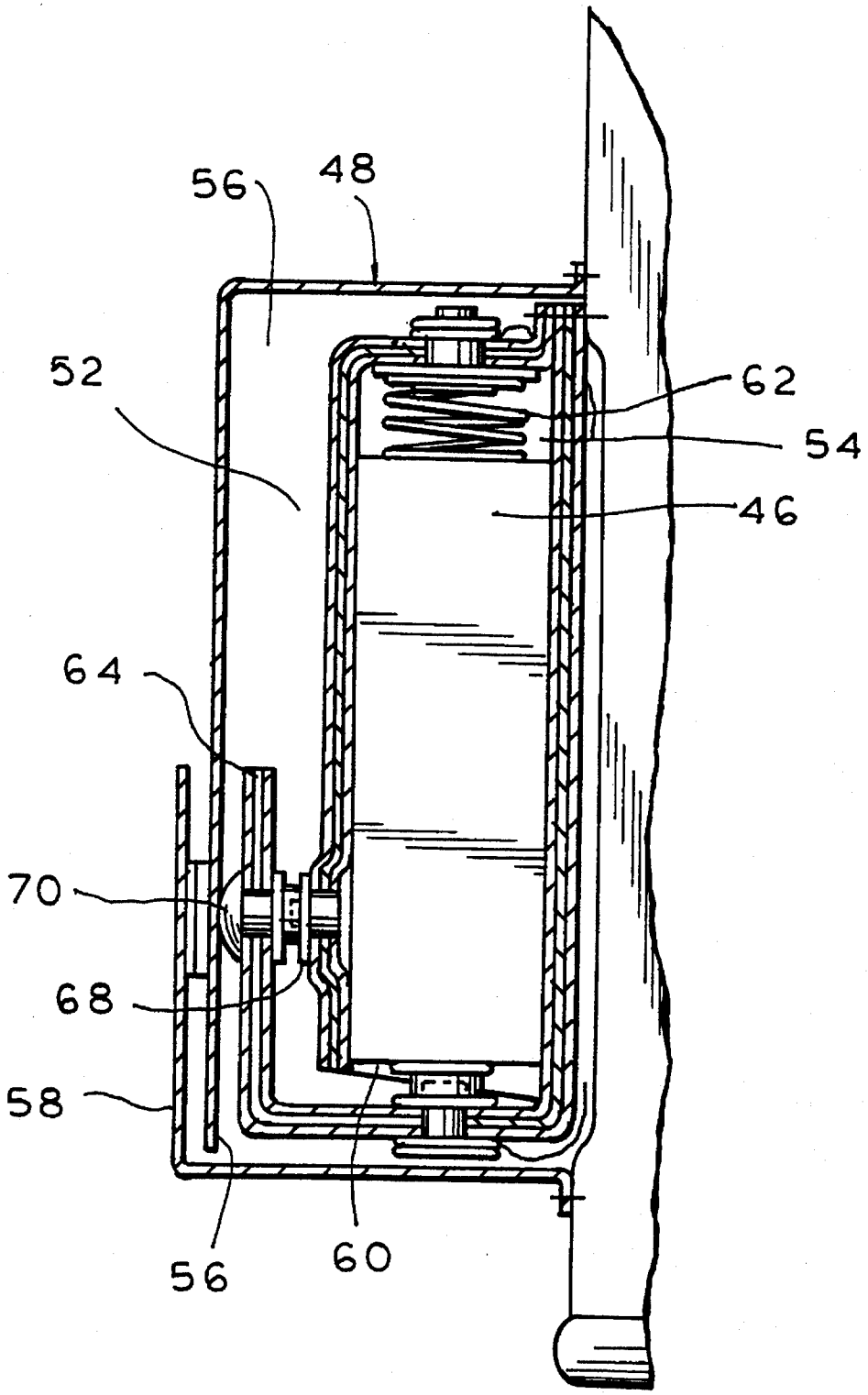
FIG. 5 is a longitudinal view taken along line 5—5 of FIG. 2.

Referring now to FIG. 4, the battery compartment 48 includes an outer compartment 52 and a smaller inner compartment 54 contained therein. The outer compartment 52 serves as a cosmetic and protective covering to the inner compartment 54 which houses the battery 46. The outer compartment 52 also serves as a storage compartment for storing extra batteries, keys, money and the like.

The outer compartment 52 includes a pouch or pocket 56 which receives the inner compartment 54. The upper portion of the outer compartment 52 also includes a flap 58 for folding over and enclosing the pocket 56 to protect the inner compartment 54 from the elements and the like and for securing effects stored in the pocket 56. The flap 58 can be secured to the pocket 56 by using a hook and loop type fastener that is sold under the trademark VELCRO. Snaps, buttons and the like can also be used.

The inner compartment 54 includes a pouch or pocket 60 for receiving the battery 46. An electrical contact member 62 made of electrically conducting material is located at the bottom of the pocket 60. The contact member 62 is electrically connected to one of the conductive wires 36, 38 and is adapted to make contact with one of the battery 46 electrodes when the battery is received in the pouch 60 and connected in circuit to the heating element 28.

The upper portion of the inner compartment 54 includes a flap 64 for folding over and enclosing the battery contained within the pocket 60. An intermediate portion of the flap 64 includes an electrical contact member 66 electrically connected to one of the other conductor wires 36, 38. The flap 64 is adapted so that whenever it is closed, the contact member 66 engages the other of the battery electrodes to complete the electrical circuit to the heating element 28, FIG. 5.

When the flap 64 is opened, the electric circuit to the heating element 28 is open. The flap 64 thus functions as a switch by which the battery 46 is connected into and out of circuit with the heating element 28, i.e. the heating element 28 is energized and radiates heat when the flap 64 is closed, and the heating element 28 is de-energized when the flap 64 is open.

To secure the flap 64 in the closed position, closure means are utilized. Preferably a male snap member 68 is connected to the outer surface of the pocket 60 and a complementary female snap member 70 is connected to the inner surface of the flap 64 to mate with the male snap member 68. Other closure means may be utilized such as VELCRO, buttons and the like.

Referring now to FIGS. 1 and 3, a strap or adjusting means 72 is formed on the wrist portion 16 on the palm side 19 of the outer shell 18. Preferably the strap 72 is a VELCRO strap. The strap 72 includes a strap member 76 secured to one side of the wrist portion 18 and a buckle member 78 secured to an opposite side of the wrist portion 18 adapted to receive the strap member 76. The strap member 76 is threaded through the underside of the buckle member 78 and out the top side of the buckle member 78. The strap member 76 is then folded back over itself and is secured by a fastening means such as VELCRO.

An elastic band 80 is formed within the glove body 12 and substantially radially encircles the glove body 12 between the hand receiving portion 14 and the wrist receiving portion 16. The elastic band 18 can be made of any of the known materials and formed within the glove body 12 in accordance with any of the known constructions for making gloves.

When a hand of a wearer is received in the hand receiving portion 14, the elasticity of the elastic band 80 causes the portion of the glove body 12 surrounding the elastic band 80 to tightly fit around the wrist of the wearer. Moreover, the strap 72 can also be adjusted to tightly fit the wrist portion 16 of the glove body 12 around the wrist of the wearer. When the strap 72 is tightened, this also causes the back side 50 of the outer shell 18 to tighten in the area around the battery compartment 48 to balance the battery 46 and keep the battery weight from shifting on the wearers hand.

The elastic band 80 and the strap 72, when tightened around the wrist of the wearer, also function to substantially seal the hand receiving portion 14 to form an insulated chamber or cocoon 82 defined by the inner liner 21 and the seal. The insulated chamber 82 is surrounded by insulation formed within the glove body 12 disposed between the outer shell 18 and the inner liner 21. In a preferred embodiment, a layer of 100% polyester fiberfill 84 and a layer of THINSULATE 86 manufactured by the 3M Company, 65% olefin and 35% polyester, are disposed between the outer shell 18 and the inner liner 21. Preferably a waterproof liner 88 is also disposed between the outer shell 18 and the inner liner 21, immediately adjacent to the outer shell 18.

In use, when the heating element 28 is energized by closing the flap 64, the heating element 28 radiates and concentrates heat into the upper palm region of the hand receiving portion 14. The heat then dissipates throughout the insulated chamber 82 towards the wrist and fingers of the wearer to keep the hand warm.

The insulation forming the insulating chamber 82 reduces the need for large amounts of heat to be radiated by larger heating elements extending throughout the glove and into the finger area as is required by heated gloves of the prior art. It should be realized by those skilled in the art that any type of insulation can be utilized in the glove of the present invention just so long as when the heating element 28 radiates and concentrates heat into the upper palm region of the hand receiving portion 14, the insulation is sufficient to allow the heat to travel within the insulated chamber 82 and provide a warm glove allowing the wearer to remain in the cold longer.

The present invention provides an electrically heated glove to warm the glove without overheating the glove enabling the wearer to remain in the cold longer. The heating means is properly located so that it is not subject to stresses and strains caused by movement of the hand or to abrasions from carrying ski poles, pails, farm equipment and the like. The glove also includes the proper amount of insulation to maximize the capture of heat and to minimize the size and bulk of the glove. It is simple and economical to use and to manufacture.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A heated glove comprising:

a glove body having an outer shell and an inner liner conforming to the shape of the glove body, the inner liner defining a hand receiving portion and including a palm side and an opposing back side, the hand receiving portion having a width and a length and an opening for receiving therethrough a hand of a glove wearer, the palm side of the inner liner including a region that lies adjacent the area substantially between the digital/palmar creases and the distal palmar creases of the palm of the glove wearer;

a heating element disposed at the region and substantially spanning across the width of the hand receiving portion, wherein the heating element does not overlap the digital/palmar creases and the distal palmar creases of the palm;

a source of energy for energizing the heating element; and a seal to substantially seal the opening during use.

2. The heated glove of claim 1, including insulation disposed between the outer shell and the inner liner.

3. The heated glove of claim 2, wherein the seal substantially seals the opening when the hand of the glove wearer is received in the hand receiving portion to form an insulated chamber defined by the inner liner and the seal, the heating element radiating heat into the insulated chamber to heat the hand of the glove wearer when the heating element is energized.

4. The heated glove of claim 2, wherein the insulation includes a plurality of insulating layers.

5. The heated glove of claim 2, wherein the insulating layers include a layer of polyester fiberfill and a layer of material made up of 65% olefin and 35% polyester.

6. The heated glove of claim 1, wherein the inner liner is made of polyester.

7. The heated glove of claim 1, wherein the outer shell is made of nylon.

8. The heated glove of claim 1, further including a waterproof liner disposed between the outer shell and the inner liner.

9. The heated glove of claim 1, wherein the heating element is a resistance type heating element.

10. The heated glove of claim 1, wherein the heating element is disposed between layers of nylon heat sensitive tape.

11. The heated glove of claim 6, wherein the inner liner includes two layers of polyester, and the heating element is disposed between the two polyester layers.

12. The heated glove of claim 3, wherein the seal includes an elastic band, the elastic band substantially sealing the inner liner of the hand receiving portion around the wrist area of the hand of the glove wearer when the hand of the glove wearer is received in the hand receiving portion.

13. The heated glove of claim 1, wherein the source of energy includes a battery.

14. The heated glove of claim 13, wherein the outer shell includes a palm side and an opposing back side.

15. The heated glove of claim 14, wherein the inner liner further defines a wrist portion integrally connected to the hand receiving portion, and the wrist portion includes a compartment on the back side of the outer shell.

16. The heated glove of claim 15, wherein the seal includes a strap, the strap substantially sealing the inner liner of the wrist portion around the wrist area of the hand of the glove wearer when the hand of the glove wearer is received in the hand receiving portion.

17. The heated glove of claim 15, wherein the compartment includes an outer compartment and an inner compartment.

18. The heated glove of claim 17, wherein the inner compartment houses the battery.

19. The heated glove of claim 18, wherein the inner compartment includes means for operatively engaging the battery and the heating element.

20. The heated glove of claim 19, wherein the inner compartment includes a switch for energizing and de-energizing the heating element.

21. The heated glove of claim 20, wherein the inner compartment includes a flap to close and open the inner compartment.

22. The heated glove of claim 21, wherein the switch is configured so that the heating element is energized when the flap is closed, and the heating element is de-energized when the flap is open.

23. The heated glove of claim 19, further including means for balancing the battery when the battery is housed in the inner compartment.

24. The heated glove of claim 23, wherein the means for balancing includes a strap.

25. A heated glove comprising:

a glove body having an outer shell and an inner liner conforming to the shape of the glove body, the inner liner defining a hand receiving portion having a palm region, a finger region a thumb region and an opening for receiving therethrough a hand of a glove wearer;

insulation disposed between the outer shell and the inner liner;

a seal to substantially seal the hand receiving portion when a hand of a glove wearer is received in the hand receiving portion to form an insulated chamber defined by the inner liner and the seal; and a heating element disposed at the inner liner, wherein the heating element is positioned so that it does not substantially bend when the palm or fingers regions of a glove wearer are bent.

* * * * *